US005285032A

United States Patent [19]

Robinette

[11] Patent Number: 5,285,032

[45] Date of Patent: Feb. 8, 1994

[54] BALL SWITCH

[76] Inventor: David H. Robinette, 6912 Senton Ave., Las Vegas, Nev. 89108

[21] Appl. No.: 999,748

[22] Filed: Dec. 31, 1992

[51] Int. Cl.[5] ..... H01H 35/14

[52] U.S. Cl. ..... 200/61.48; 200/61.5

[58] Field of Search ..... 200/61.45 R, 61.48, 200/61.49, 61.5, 61.51, 61.52, DIG. 29, 332

[56] References Cited

U.S. PATENT DOCUMENTS

| | | | |
|---|---|---|---|
| 3,674,950 | 7/1972 | Scoville | 200/61.48 |
| 3,816,680 | 6/1974 | Suzuki et al. | 200/61.51 |
| 3,927,286 | 12/1975 | Fohl | 200/61.45 R |
| 4,071,723 | 1/1978 | Jackman | 200/61.45 R |
| 4,345,238 | 8/1982 | Weir | 200/61.45 R X |
| 4,394,553 | 7/1983 | Feil | 200/332 X |
| 4,628,160 | 12/1986 | Canevari | 200/61.45 R |
| 4,789,922 | 12/1988 | Cheshire | 200/61.52 X |
| 5,027,105 | 6/1991 | Dailey et al. | 200/61.45 R X |
| 5,136,126 | 8/1992 | Blair | 200/61.52 X |

*Primary Examiner*—J. R. Scott

*Attorney, Agent, or Firm*—Robert M. Sperry

[57] ABSTRACT

An improved motion-actuated switch comprising a housing, a normally open snap action switch mounted within the housing actuable by a lever arm having a triangular member formed of sheet material extending substantially vertically upward from the arm, and a ball member suspended pendulously within the housing and normally engaging the tip of the triangular member to maintain the lever arm in its open circuit position and having space within the housing to permit movement of the ball member out of contact with the triangular member to allow closing of the switch.

6 Claims, 1 Drawing Sheet

BALL SWITCH

BACKGROUND

1. Field of Invention

This invention relates to electrical switches and is particularly directed to motion-actuated switches for controlling electrical circuits.

2. Prior Art

Motion-activated switches are widely used to control electrical circuits in response to motion resulting from acceleration, vibration, seismic activity or numerous other causes. Such switches may trigger alarms, or may control the activation or deactivation of various types of equipment. Thus, for example, in the event of an earthquake, motion-activated switches can automatically sound an alarm, actuate solenoid valves to shut off gas lines, etc. Numerous types of motion-activated switches have been proposed heretofore. However, many of the prior art motion-activated switches have been limited in response to a particular type of motion, such as tilting but not longitudinal motion or vice versa. Other prior art motion-activated switches have been responsive only to relatively cross motion and cannot be triggered by subtle movements. Still other prior art motion-activated switches have been complex and expensive, have required considerable maintenance or have been bulky in size and weight. A search in the United States Patent Office has revealed the following references:

| U.S. Pat. No. | INVENTOR | ISSUED |
|---|---|---|
| 5,136,126 | C. D. Blair | Aug. 4, 1992 |
| 5,027,105 | T. A. Dailet et al | Jun. 25, 1991 |
| 4,789,922 | T. Cheshire | Dec. 6, 1988 |
| 4,628,160 | R. D. Canevari | Dec. 9, 1986 |

Each of these references is subject to the disadvantages discussed above. Thus, none of the prior art motion-activated switches has been entirely satisfactory.

BRIEF SUMMARY AND OBJECTS OF INVENTION

These disadvantages of the prior art are overcome with the present invention and an improved motion-activated switch is provided which is simple and inexpensive to purchase and install, requires little or no maintenance, and is compact in size and weight, yet which is highly sensitive to even subtle movements of virtually any type or direction.

These advantages of the present invention are preferably attained by providing an improved motion-activated switch comprising a housing, a normally open snap action switch mounted within the housing actuable by a lever arm having a triangular member formed of sheet material extending substantially vertically upward from the arm, and a ball member suspended pendulously within the housing and normally engaging the tip of the triangular member to maintain the lever arm in its open circuit position and having space within the housing to permit movement of the ball member out of contact with the triangular member to allow closing of the switch.

Accordingly, it is an object of the present invention to provide an improved motion-actuated switch.

Another object of the present invention is to provide an improved motion-actuated switch which is simple and inexpensive to purchase and install.

An additional object of the present invention is to provide an improved motion-actuated switch which requires little or no maintenance.

A further object of the present invention is to provide an improved motion-actuated switch which is compact in size and weight.

Another object of the present invention is to provide an improved motion-actuated switch is highly sensitive to even subtle movements of virtually any type or direction.

A specific object of the present invention is to provide an improved motion-actuated switch comprising a housing, a normally open snap action switch mounted within the housing actuable by a lever arm having a triangular member formed of sheet material extending substantially vertically upward from the arm, and a ball member suspended pendulously within the housing and normally engaging the tip of the triangular member to maintain the lever arm in its open circuit position and having space within the housing to permit movement of the ball member out of contact with the triangular member to allow closing of the switch.

These and other objects and features of the present invention will be apparent from the following detailed description, taken with reference to the figures of the accompanying drawing.

DETAILED DESCRIPTION OF THE INVENTION

Figure 1:
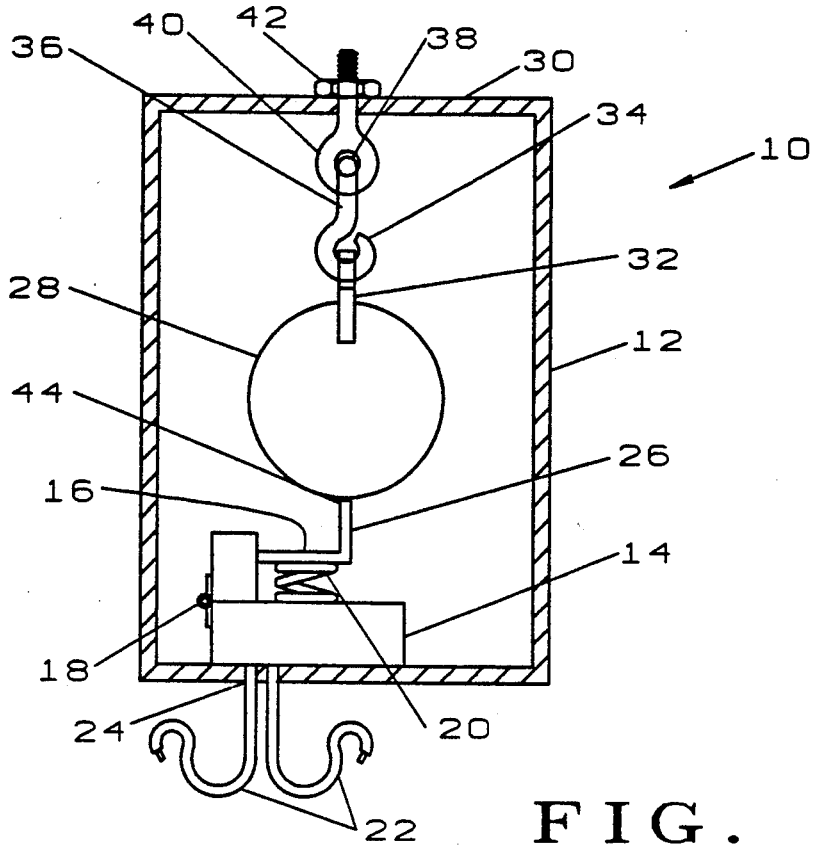
FIG. 1 is a vertical section through a motion-actuated switch embodying the present invention.
Figure 2:
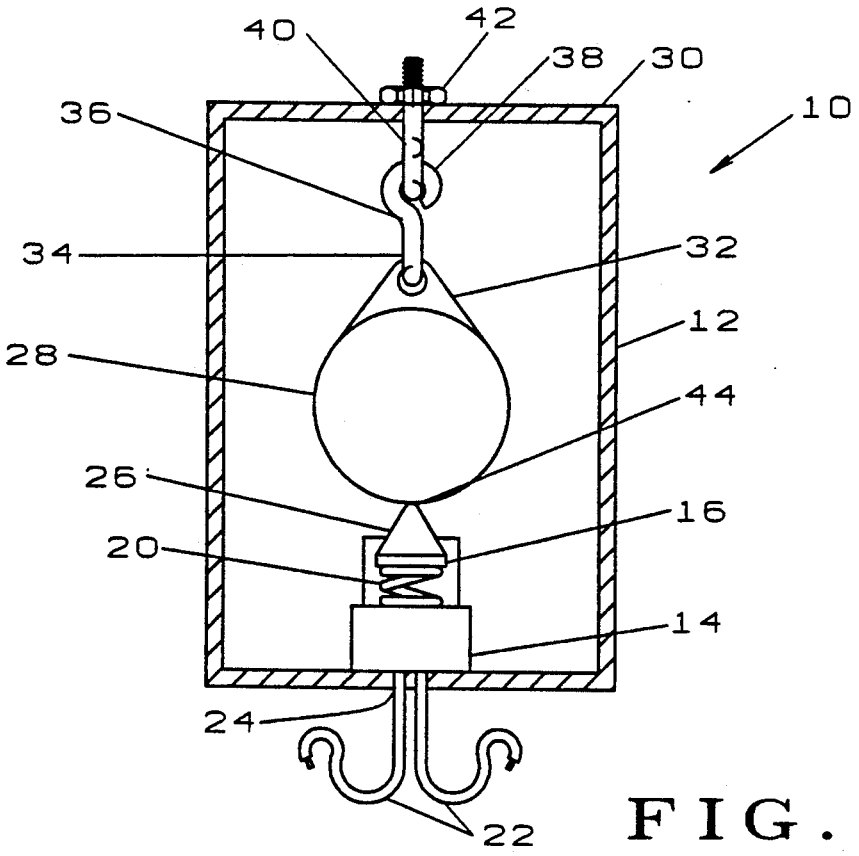
FIG. 2 is an end view of the switch of FIG. 1.

In that form of the present invention chosen for purposes of illustration in the drawing, FIGS. 1 and 2 show a motion-actuated switch, indicated generally at 10, having a generally cylindrical housing 12. A snap-action switch 14 is mounted within the housing 12 and has a lever arm 16 hingedly mounted on the switch 14, as indicated at 18 in FIG. 1, and urged upwardly by suitable means, such as spring 20. The switch 14 is connected to appropriate circuitry by wires 22, which pass through opening 24 of the housing 12 and is in the open circuit position when the lever arm 16 is in the position seen in FIGS. 1 and 2, but serves to close the circuit when the lever arm 16 is urged upward by spring 20. The lever arm 16 carries a triangular member 26 which projects vertically upward from the lever arm 16 and which is formed of sheet material, as best seen in FIG. 1. Finally, a ball member 28 is pendulously suspended from the roof 30 of the housing 12, as by strap 32, which is hung on the lower hook 34 of link 36 which has an upper hook 38 engaging an eyebolt 40 that is secured to the roof 30 of the housing 12 by suitable means, such as nut 42. If desired, the nut 42 may be adjusted to vary the position of the ball member 28 and, hence, to control the sensitivity of the switch 10.

In use, the ball member 28 is normally positioned to rest on the tip 44 of the triangular member 26, as seen in FIGS. 1 and 2, and, thus, serves to normally hold the lever arm 16 in its open circuit position. However, it will be apparent that any movement of the housing 12 will serve to displace the ball member 28 from the tip 44 of the triangular member 26, whereupon, spring 20 will urge the lever arm 16 upward to its closed circuit position and, hence, will send an electrical signal through wires 24 to trigger an alarm or to perform appropriate operations. It will be apparent that any lateral or tilting movement of the housing 12 will cause the ball member 28 to be displaced from the tip 44 of the triangular member 26 and will allow spring 20 to move the lever arm 16 upward and, hence, will allow the snap-action switch 14 to actuate the circuit through wires 22. Moreover, vertical motion will effectively cause the triangular member 26 to toss the ball member 28 upward, which will also serve to displace the ball member 28 from the tip 44 of the triangular member 26, which will allow spring 20 to lift the lever arm 16 and will allow the snap-action switch 14 to actuate the circuit through wires 22. Finally, if desired, the ball member 28 may be formed of material having a relatively low meltinq point. Thus, in the event of fire, the heat of the fire will melt the ball member 28, which will release the lever arm 16 for movement by spring 20 to actuate the snap-action switch 14.

Obviously, numerous other variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A switch comprising:

a levered contact arm movable between a lower open circuit position and a raised closed circuit position, a tip projecting vertically upward from said arm, resilient means urging said arm to its closed position, and a rounded inertial means pendulously suspended to normally rest on said tip to normally retain said arm is its open circuit position.

2. The switch of claim 1 further comprising:

a housing enclosing said switch and having a roof with said inertial means being suspended from said roof.

3. The switch of claim 1 wherein:

said resilient means is a spring.

4. The switch of claim 1 wherein:

said inertial means is formed of material having a low melting point.

5. The switch of claim 1 wherein:

said tip is triangular and is formed of sheet material.

6. The switch of claim 1 wherein: said inertial means is a ball.

* * * * *